US012187402B2

(12) United States Patent
Kirihara et al.

(10) Patent No.: US 12,187,402 B2
(45) Date of Patent: Jan. 7, 2025

(54) SHIP STEERING DEVICE

(71) Applicant: Hitachi Astemo, Ltd., Hitachinaka (JP)

(72) Inventors: Kenichi Kirihara, Hitachinaka (JP); Norio Kikuchi, Hitachinaka (JP); Yusuke Amma, Hitachinaka (JP); Kyohei Fukushi, Hitachinaka (JP); Akihiro Kogure, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 427 days.

(21) Appl. No.: 17/665,721

(22) Filed: Feb. 7, 2022

(65) Prior Publication Data

US 2022/0315194 A1 Oct. 6, 2022

(30) Foreign Application Priority Data

Mar. 30, 2021 (JP) ..... 2021-057001

(51) Int. Cl.
*B63H 25/42* (2006.01)
*B63H 25/24* (2006.01)

(52) U.S. Cl.
CPC ..... *B63H 25/42* (2013.01); *B63H 25/24* (2013.01)

(58) Field of Classification Search
CPC ..... B63H 25/24
See application file for complete search history.

(56) References Cited

U.S. PATENT DOCUMENTS

| | | | | |
|---|---|---|---|---|
| 2006/0180070 | A1* | 8/2006 | Mizutani | B63H 25/02 114/144 R |
| 2006/0217012 | A1* | 9/2006 | Mizutani | B63H 20/12 440/61 S |
| 2008/0210148 | A1* | 9/2008 | Mizutani | B63H 20/12 114/144 RE |
| 2017/0139426 | A1* | 5/2017 | Ito | B63H 25/42 |
| 2019/0235528 | A1 | 8/2019 | Ito et al. | |
| 2022/0315194 | A1* | 10/2022 | Kirihara | B63H 25/24 |

FOREIGN PATENT DOCUMENTS

| | | | | |
|---|---|---|---|---|
| JP | S54-162395 A | | 12/1979 | |
| JP | 2007-062677 | | 3/2007 | |
| JP | 2007062677 A | * | 3/2007 | B63B 79/10 |
| JP | 2011093497 A | * | 5/2011 | B63H 20/12 |

* cited by examiner

*Primary Examiner* — S. Joseph Morano
*Assistant Examiner* — Jovon E Hayes
(74) *Attorney, Agent, or Firm* — Rankin, Hill & Clark LLP

(57) ABSTRACT

A ship steering device includes a handle which is mechanically separated from a rudder mechanism, a steering angle detecting unit that detects a steering angle of the handle, a rudder motor that drives the rudder mechanism, and a turn controller that controls, based on a steering characteristics map which associates a basic relation between the steering angle and a turn angle, the rudder motor so as to obtain the turn angle in accordance with the steering angle. The steering characteristics map has a characteristic such that, in a second steering region where the steering angle is larger than the steering angle in a first steering region, a change amount of the turn angle relative to the steering angle is large with respect to the first steering region where the steering angle is set from zero in advance.

6 Claims, 17 Drawing Sheets

SHIP STEERING DEVICE

FIELD OF THE INVENTION

The present disclosure relates to a ship steering device.

BACKGROUND

Electrically assisted hydraulic steering technologies are now adopted to ship steering devices. Regarding the electrically assisted hydraulic steering, however, there is a leeway for an improvement in view of a steering feeling and/or of a ship response performance. Hence, in recent years, a development of a so-called steer-by-wire ship steering device that employs a structure in which a handle at a driver's seat and a rudder mechanism of an outboard motor are mechanically separated from each other is advancing. For example, following Patent Document 1 discloses a conventional technology relating to the ship steering device of this type.

According to the ship steering device disclosed in Patent Document 1, the handle at the driver's seat is mechanically separated from the rudder mechanism of the outboard motor, and the handle is also capable of electrically operating the rudder mechanism. The rudder mechanism turns the outboard motor by power from a rudder motor controlled based on the steering angle of the handle.

[Patent Document 1] JP 2007-62677 A

When the steer-by-wire scheme is adopted as disclosed in Patent Document 1, the ship handling effort on a ship handling person can be reduced by appropriately turning the outboard motor at a desired turn angle in accordance with the steering angle of the handle.

An objective of the present disclosure is to provide a ship steering device capable of reducing a ship handling effort on a ship handling person.

SUMMARY OF THE INVENTION

The inventors of the present disclosure focus that, upon keen examination, since a constant displacement force acts on the rudder, i.e., the outboard motor due to the difference in water repelling characteristics of the propeller of the outboard motor at the right side and at the left side, when the handle is at a neutral position, the ship travels in a certain displaced direction. Moreover, the inventors of the present disclosure found that by associating the steering angle of the handle with the turn angle required for the outboard motor by a steering characteristics map, a ship steering device can be obtained which can further reduce the ship handling effort on the ship handling person in comparison with conventional technologies. The present disclosure is accomplished based on such finding. The present disclosure has been made in view of the above-described technical problems, and an objective is to provide a ship steering device that can reduce the ship handling effort on a ship handling person in a steer-by-wire steering device.

The present disclosure will be described below. However, the present disclosure is not limited to the embodiments illustrated in the accompanying drawings.

According to the present disclosure, there is provided a ship steering device that includes:

an outboard motor attachable to a ship;

a rudder motor that drives a rudder mechanism of the outboard motor;

a handle which is mechanically separated from the rudder mechanism, and which is capable of electrically operating the rudder mechanism;

a steering angle detecting unit that detects a steering angle of the handle;

a reaction force motor that generates reaction force torque to be applied to the handle;

a storing unit that stores a steering characteristics map which associates a basic relation between the steering angle and a turn angle of the outboard motor; and a turn controller that controls, based on the steering characteristics map, a drive current value which drives the rudder motor so as to obtain the turn angle in accordance with the steering angle, in which the steering characteristics map has a characteristic such that, in a second steering region where the steering angle is larger than the steering angle in a first steering region, a change amount of the turn angle relative to the steering angle is large with respect to the first steering region where the steering angle is set from zero in advance.

According to the present disclosure, a ship steering device capable of reducing a ship handing effort on a ship handling person is provided.

DETAILED DESCRIPTION OF THE EMBODIMENTS

Embodiments of the present disclosure will be described with reference to the accompanying figures. Note that the embodiments illustrated in the figures are merely examples of the present disclosure, and the present disclosure is not limited to such embodiments. In the following description, the right and left sides mean respectively the right and left sides with reference to a straight-traveling state of a ship, and the front and rear sides mean respectively the front and rear sides with reference to the straight-traveling state of the ship. Moreover, in the figures, Fr, Rr, Li, and Ri indicate the front side (a traveling direction), the rear side (the opposite direction to the traveling direction), the left side, and the right side, respectively.

First Embodiment

Figure 1:
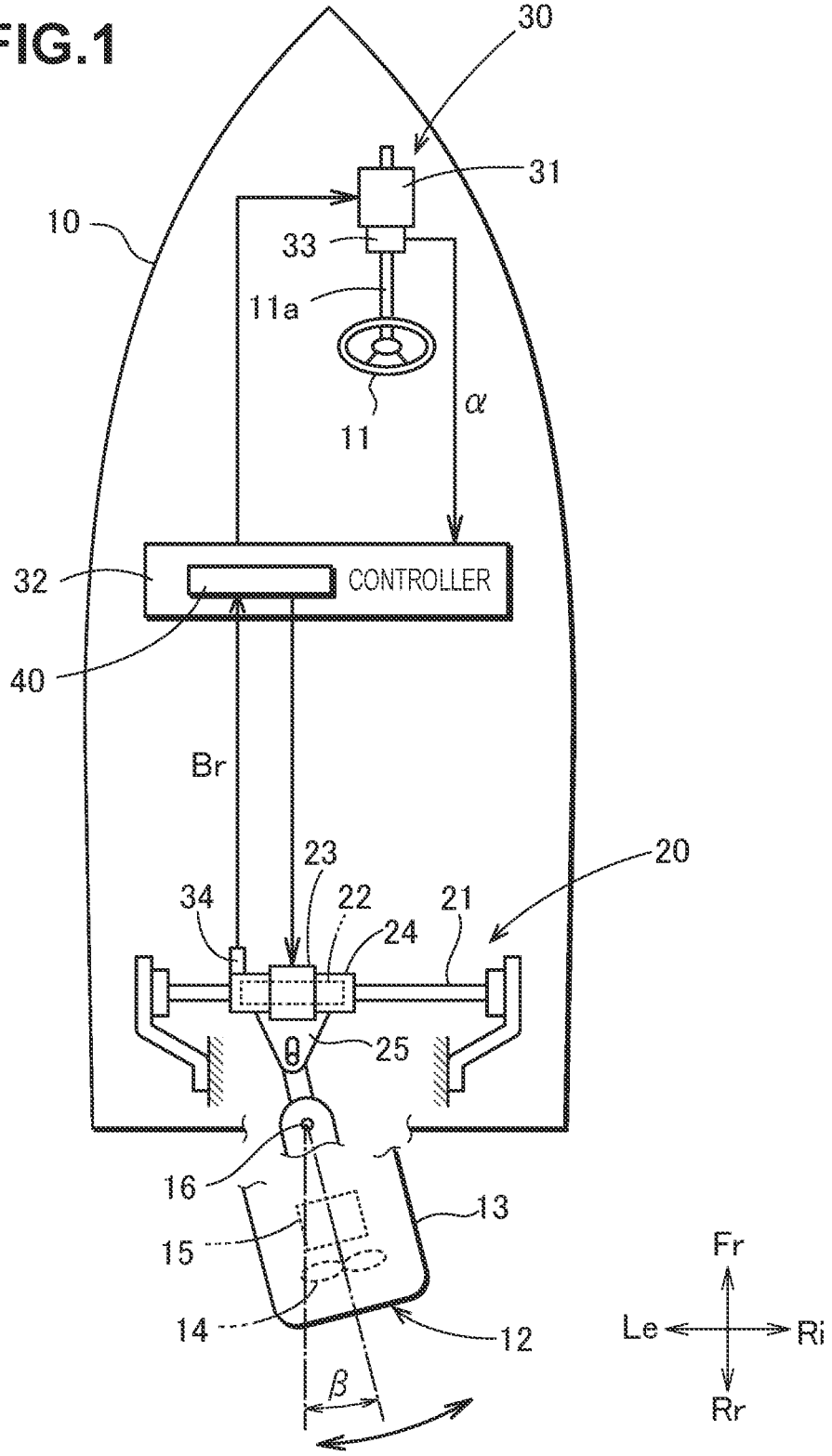
FIG. 1 is a planar schematic diagram of a ship on which a ship steering device according to a first embodiment is loaded.
Figure 2:
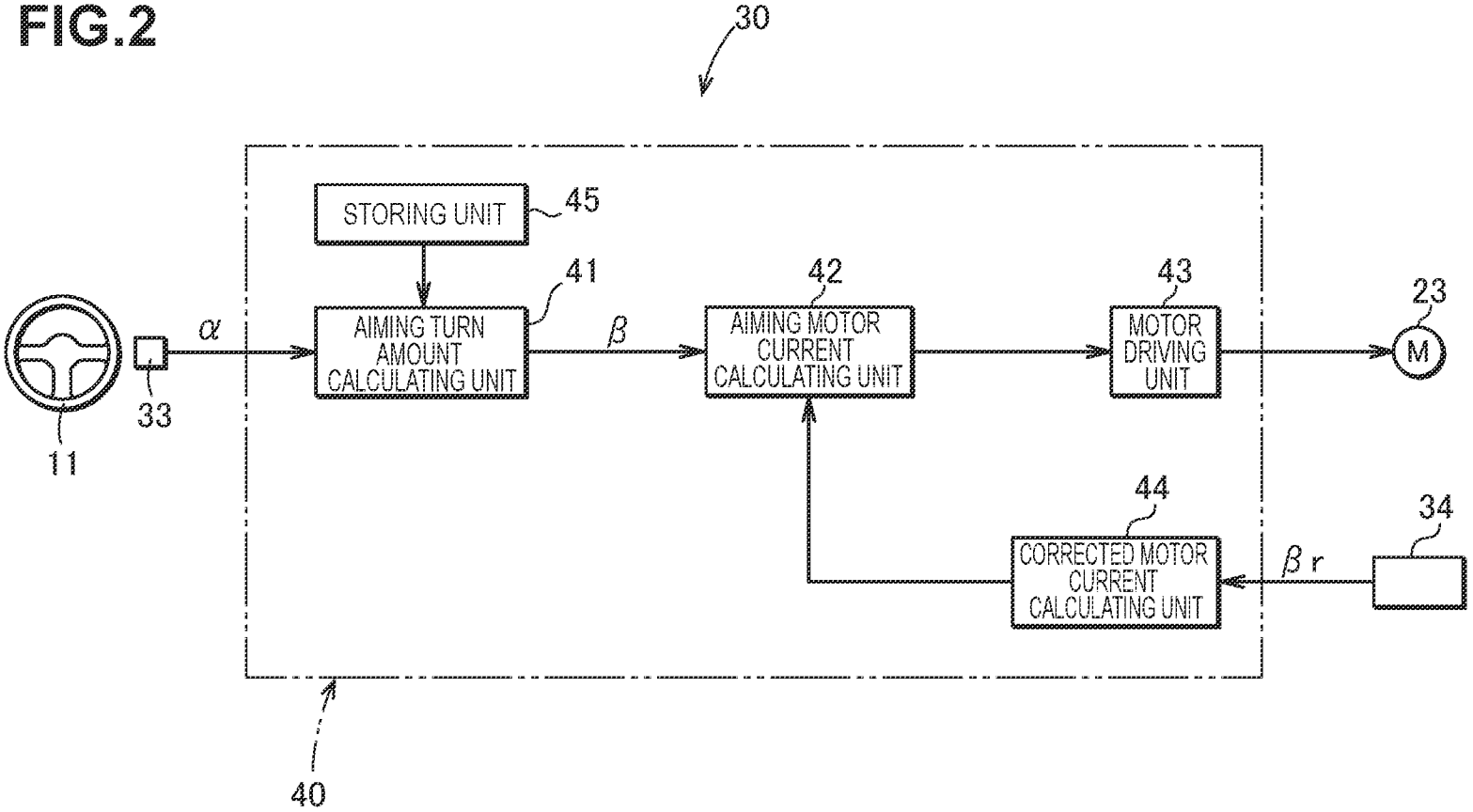
FIG. 2 is a block diagram for describing the details of a control on the ship steering device illustrated in FIG. 1.
Figure 3:
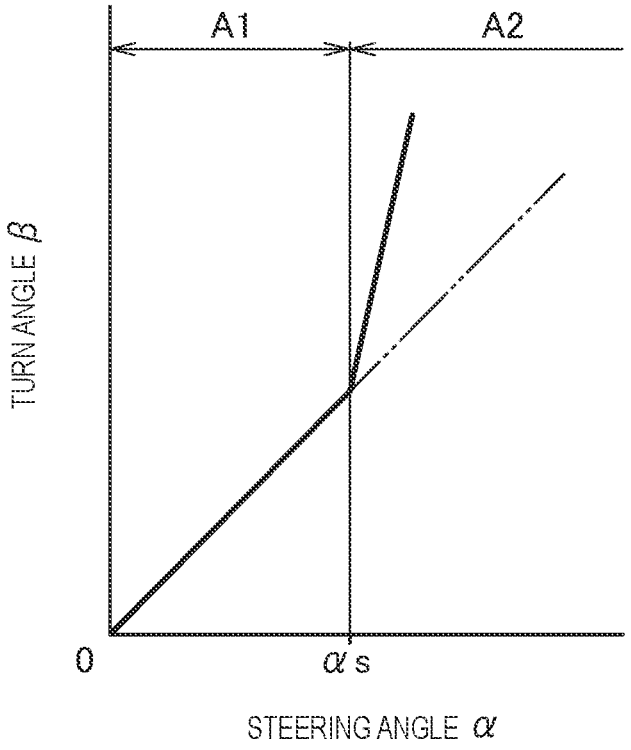
FIG. 3 is a conceptual diagram for a steering characteristics map stored in a storing unit illustrated in FIG. 2.

With reference to FIGS. 1 to 3, a ship 10 according to a first embodiment, and a ship steering device 30 loaded on the ship 10 will be described.

As illustrated in FIG. 1, the ship 10 includes a handle 11 (a steering member 11) at the front side, and also includes an outboard motor 12 at the rear side. The outboard motor 12 includes an outboard motor body 13, a propeller 14 provided below the outboard motor body 13, and a power source 15 that drives the propeller 14. The front section of the outboard motor 12 is supported by a swivel shaft 16 (a vertical shaft 16) perpendicular to the ship 10 so as to be swingable to the right and left sides, and the front section of the outboard motor 12 is coupled to a rudder mechanism 20.

The rudder mechanism 20 includes, for example, a fixed shaft 21 elongated in the widthwise direction of the ship 10, a rudder motor 23 that has an output shaft connected to the fixed shaft 21 through a ball screw mechanism 22, a movable body 24 movable together with the rudder motor 23 along the fixed shaft 21, and a linkage mechanism 25 coupled to the movable body 24. This linkage mechanism 25 is coupled to the outboard motor body 13.

The power by the rudder motor 23 is converted into a linear motion of the movable body 24 in the direction along the fixed shaft 21 through the ball screw mechanism 22. The linear motion of the movable body 24 is converted into a right-and-left swing motion of the outboard motor 12 around the swivel shaft 16 through the linkage mechanism 25. Thus, the rudder mechanism 20 is turned by changing the direction of the outboard motor 12 by the power of the rudder motor 23.

The ship steering device 30 employs a so-called steer-by-wire structure in which the handle 11 at the driver's seat and the rudder mechanism 20 of the outboard motor 12 are mechanically separated from each other, and the rudder mechanism 20 can be electrically steered via the handle 11.

The handle 11 is, for example, a steering wheel, and includes a steering shaft 11*a*. A reaction force motor 31 that applies steering reaction force (reaction force torque) to the handle 11 is coupled to the steering shaft 11*a*. The reaction force motor 31 (being included in various kinds of unillustrated actuators) gives a steering feeling to a ship handling person by generating reaction force torque against the steering force of the handle 11 turned by the ship handling person.

Steering information on the handle 11 and turn information on the rudder mechanism 20 are sent to the controller 32. An example or a piece of the steering information is or includes a steering angle $\alpha$ of the handle 11 detected by a steering angle detecting unit 33. An example or a piece of the turn information is or includes a direction (a turn angle $\beta r$) of the outboard motor 12 detected by a turn angle detecting unit 34.

The controller 32 is, for example, an Electronic Control Unit (ECU) including a microcomputer, etc., and drives and controls the reaction force motor 31 and the rudder motor 23 based on various kinds of information including the steering information on the handle 11 and the turn information on the rudder mechanism 20. Moreover, the controller 32 includes a turn controller 40 that drives and controls the rudder motor 23.

As illustrated in FIG. 2, the turn controller 40 has a plurality of functional processing units accomplished by, for example, software when a computer executes predetermined program processes. This turn controller 40 includes an aiming turn amount calculating unit 41 that calculates an aiming turn amount (an aiming turn angle $\beta$) in accordance with the steering angle $\alpha$ detected by the steering angle detecting unit 33, an aiming motor current calculating unit 42 that decides an aiming current to the rudder motor 23 in accordance with the aiming turn amount output by the aiming turn amount calculating unit 41, a motor driving unit 43 that drives the rudder motor 23 by, for example, PWM control in accordance with the aiming current output by the aiming motor current calculating unit 42, and a corrected motor current calculating unit 44 that corrects the aiming current of the aiming motor current calculating unit 42 in accordance with an actual turn angle $\beta r$ detected by the turn angle detecting unit 34.

The rudder motor 23 driven as described above is driven so as to obtain the turn angle $\beta$ in accordance with the steering angle $\alpha$ of the handle 11.

The turn controller 40 includes a storing unit 45 that stores a steering characteristics map. Note that the storing unit 45 may be formed separately form the turn controller 40.

With reference to also FIG. 3, the steering characteristics map associates the basic relation between the steering angle $\alpha$ detected by the steering angle detecting unit 33, and the turn angle $\beta$, and maps such an association.

In this example, the operation of the handle 11 by the ship handling person will be defined as follows. An operation of increasing the steering angle $\alpha$ of the handle 11 by the ship handling person will be referred to as a "steering increase operation". An operation of reducing the steering angle $\alpha$ of the handle 11 by the ship handling person, i.e., an operation of returning the handle 11 to the neutral direction will be referred to as a "steering return operation".

As illustrated in FIG. 3, the steering characteristics map has, with a horizontal axis representing the steering angle $\alpha$ and the vertical axis representing the turn angle $\beta$, a characteristic (a basic characteristic indicated by a thick continuous line) of obtaining the turn angle β relative to the steering angle α. The basic characteristic indicated by the thick continuous line will be referred to as a basic characteristic Q1 (the reference symbol Q1 is not illustrated in FIG. 3).

According to the basic characteristic Q1, there is a characteristic such that the turn angle β ever-increases as the steering angle α increases from zero.

More specifically, according to the basic characteristic Q1, when the steering angle α is zero (i.e., when the handle 11 is located at the neutral position), the aiming turn angle β is set to be zero. Moreover, the basic characteristic Q1 has a characteristic such that, in a second steering region A2 where the steering angle α is larger than that of a first steering region A1, the change amount in the turn angle β relative to the steering angle α is large with respect to the first steering region A1 where the steering angle α is set from zero in advance (e.g., the inclination of a straight line representing the characteristic is large). Thus, the basic characteristic Q1 has a large difference in the change amount of the turn angle β relative to the steering angle α at a boundary as (a boundary steering angle αs) between the first steering region A1 and the second steering region A2. That is, the basic characteristic Q1 has a characteristic such as being bent at the boundary steering angle αs.

Next, with reference to FIGS. 2 and 3, actions of the turn controller 40 will be described. The aiming turn amount calculating unit 41 obtains the aiming turn angle β in accordance with the steering angle α detected by the steering angle detecting unit 33 and with the characteristic of the steering characteristics map illustrated in FIG. 3, and outputs a command signal in accordance with this turn angle β. The aiming motor current calculating unit 42 decides the aiming current to the rudder motor 23 in accordance with the command signal output by the aiming turn amount calculating unit 41, and controls the current to be output to the rudder motor 23 in accordance with the aiming current. The motor driving unit 43 drives the rudder motor 23 in accordance with the current control signal output by the aiming motor current calculating unit 42. The corrected motor current calculating unit 44 decides the corrected current in accordance with the actual turn angle βr detected by the turn angle detecting unit 34, and corrects (executes a feedback control on) the aiming current of the aiming motor current calculating unit 42.

As described above, based on the steering characteristics map, the turn controller 40 controls the drive current value that drives the rudder motor 23 so as to obtain the turn angle β in accordance with the steering angle α.

The first embodiment can be summarized as follows.

As illustrated in FIG. 1 to FIG. 3, the ship steering device 30 includes the outboard motor 12 attachable to the ship 10, the rudder motor 23 that drives the rudder mechanism 20 of the outboard motor 12, the handle 11 which is mechanically separated from the rudder mechanism 20, and which is capable of electrically operating the rudder mechanism 20, the steering angle detecting unit 33 that detects the steering angle α of the handle 11, the reaction force motor 31 that generates reaction force torque to be applied to the handle 11, the storing unit 45 that stores the steering characteristics map which associates the basic relation between the steering angle α and the turn angle β of the outboard motor 10, and the turn controller 40 that controls, based on the steering characteristics map, the drive current value which drives the rudder motor 23 so as to obtain the turn angle β in accordance with the steering angle α. The steering characteristics map has a characteristic such that, in the second steering region A2 where the steering angle α is larger than that of the first steering region A1, the change amount of the turn angle β relative to the steering angle α is large with respect to the first steering region A1 where the steering angle α is set from zero in advance.

As described above, the turn controller 40 controls the rudder motor 23 based on the steering characteristics map that associates the basic relation between the steering angle α and the turn angle β. By utilizing the turn characteristic map, the outboard motor 12 can be turned appropriately at the desired turn angle β in accordance with the steering angle α of the handle 11. Consequently, the ship steering device 30 that reduces the ship handling effort on the ship handling person can be provided.

Moreover, as illustrated in FIG. 3, the steering characteristics map has a characteristic such that, in the second steering region A2 where the steering angle α is larger than that of the first steering region A1, the change amount of the turn angle β relative to the steering angle α is large with respect to the first steering region A1 where the steering angle α is set from zero in advance. That is, in the first steering region A1, the change amount of the turn angle β moderately increases relative to the change amount of the steering angle α. In the second steering region A2, the change amount of the turn angle β keenly increases relative to the change amount of the steering angle α.

When the ship 10 travels at fast speed or when the steering 11 is slightly operated, the handle 11 is controlled within the small steering angle region A1 where the steering angle α is small. When the change in the turn angle β of the outboard motor 12 relative to the steering angle α of the handle 11 is excessively sensitive, the controllability and stability of the ship steering device 30 decrease. In contrast, within the small steering angle region A1 (the first steering region A1), the characteristic is adopted which moderately increases the change amount of the turn angle β relative to the change amount of the steering angle α. Hence, both the controllability and the stability of the ship steering device 30 can be ensured.

Conversely, when the ship handling person operates the ship to travel at a slow speed to make a U-turn, to leave shore, or to reach shore, the handle 11 is operated within the large steering angle region A2 (the second steering region A2) where the steering angle α is large. When the change in the turn angle β of the outboard motor 12 relative to the steering angle α of the handle 11 is moderate, the response of the ship is little with respect to the steering amount, and thus it is necessary to increase the steering amount. In contrast, within the large steering angle region A2, the characteristic keenly changes the change amount of the turn angle β relative to the change amount of the steering angle α. Consequently, the response of the ship 10 can be improved. Reduction of the steering amount can reduce the ship handling effort on the ship handling person.

Thus, both the accomplishment of the controllability and stability of the ship steering device 30, and the reduction of the ship handling effort on the ship handling person, can be achieved.

Note that the boundary steering angle αs in the steering characteristics map is set to the optimized steering angle with the controllability of the handle 11 by the ship handling person being taken into consideration.

Second Embodiment

A ship steering device 130 according to a second embodiment will be described with reference to FIG. 4 to FIG. 6.

The ship steering device 130 of the second embodiment has a feature such that a ship speed detecting unit 131 is added to the structure of the first embodiment. The detailed description on the same structure as that of the first embodiment will be omitted as appropriate.

Figure 4:
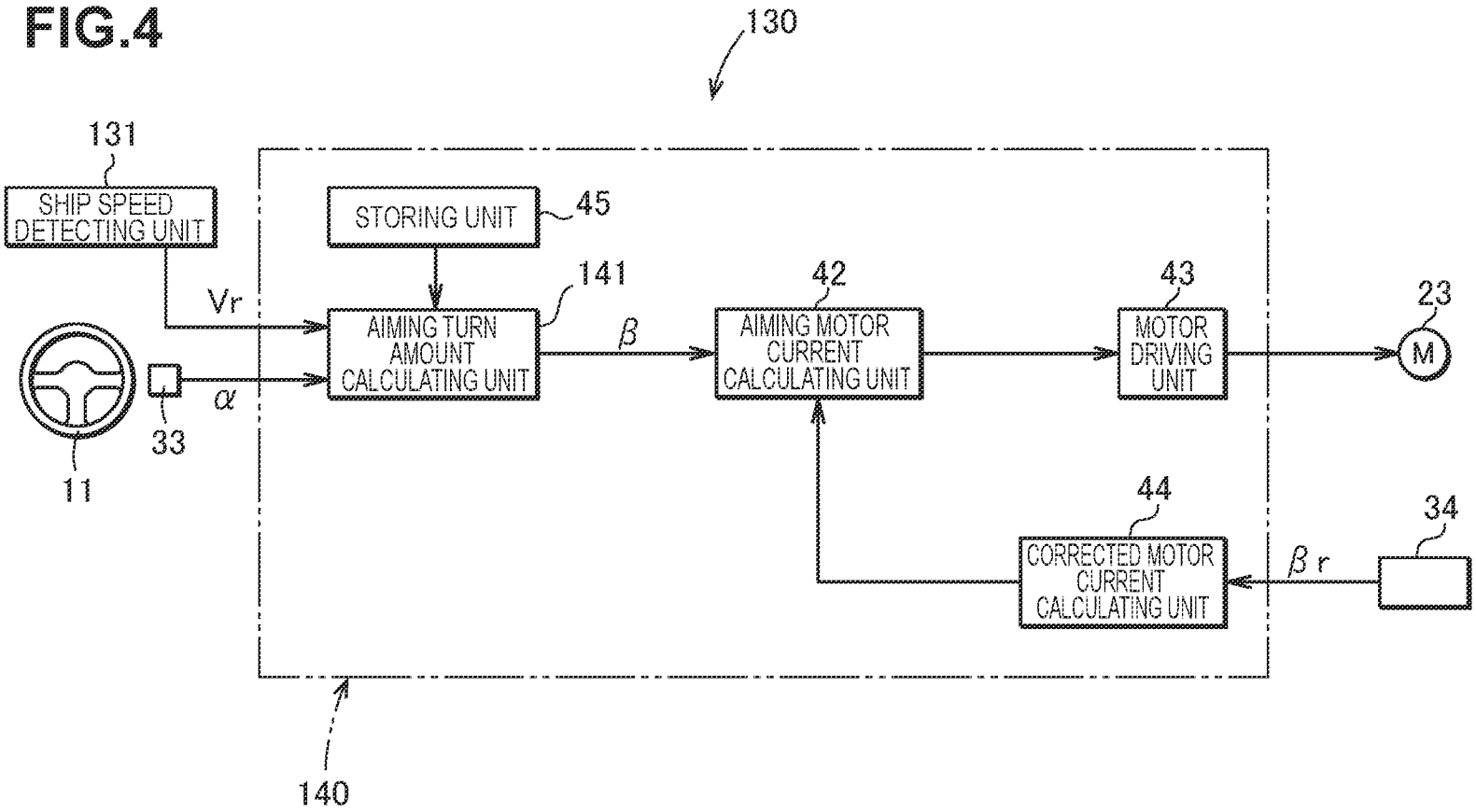
FIG. 4 is a block diagram for describing the details of a control on a ship steering device according to a second embodiment.

As illustrated in FIG. 4, the ship steering device 130 of the second embodiment includes the ship speed detecting unit 131 that detects a speed Vr of the ship 10 (a ship speed Vr). A turn controller 140 corresponds to the turn controller 40 of the first embodiment (see FIG. 2). An aiming turn amount calculating unit 141 of the turn controller 140 calculates the aiming turn angle β in accordance with the steering angle α and with the ship speed Vr.

Figure 5:
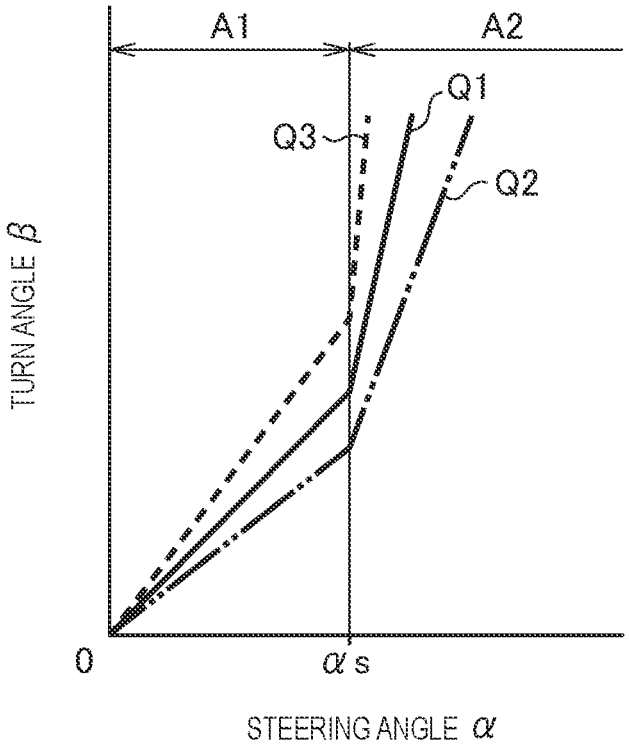
FIG. 5 is a conceptual diagram of a first steering characteristics map stored in a storing unit illustrated in FIG. 4.

A steering characteristics map of the second embodiment illustrated in FIG. 5 corresponds to that of the first embodiment illustrated in FIG. 3. The steering characteristics map illustrated in FIG. 5 has a characteristic such that the faster the speed Vr of the ship 10 (the ship speed Vr) is, the smaller the ratio of the turn angle β relative to the steering angle α becomes.

For example, according to the steering characteristics map illustrated in FIG. 5, the basic characteristic Q1 of the first embodiment (see FIG. 3) is adopted as the characteristic curve in the case of a reference ship speed that is set in advance. That is, the basic characteristic Q1 illustrated in FIG. 5 has the same characteristic as the basic characteristic illustrated in FIG. 3. With reference to the basis characteristic Q1, when the ship speed Vr is fast, a fast-speed characteristic Q2 indicated by a two-dot line is set, and when the ship speed Vr is slow, a slow-speed characteristic Q3 indicated by a dashed line is set. The characteristics of the fast-speed characteristic Q2 have a small ratio of the turn angle β relative to the steering angle α with respect to the characteristics of the basic characteristic Q1. The characteristics of the slow-speed characteristic Q3 have a large ratio of the turn angle β relative to the steering angle α with respect to the characteristics of the basic characteristic Q1.

In all the characteristics Q1, Q2, and Q3, the change amount of the turn angle β relative to the steering angle α (e.g., the inclination of the straight line indicating the characteristic) at the boundary steering angle αs remarkably differs. That is, all the characteristics Q1, Q2 and Q3 have a characteristic such as being bent at the boundary steering angle αs. Note that the characteristics in accordance with the ship speed Vr are not limited to the three characteristics Q1, Q2, and Q3, and may be set further finely.

Figure 6:
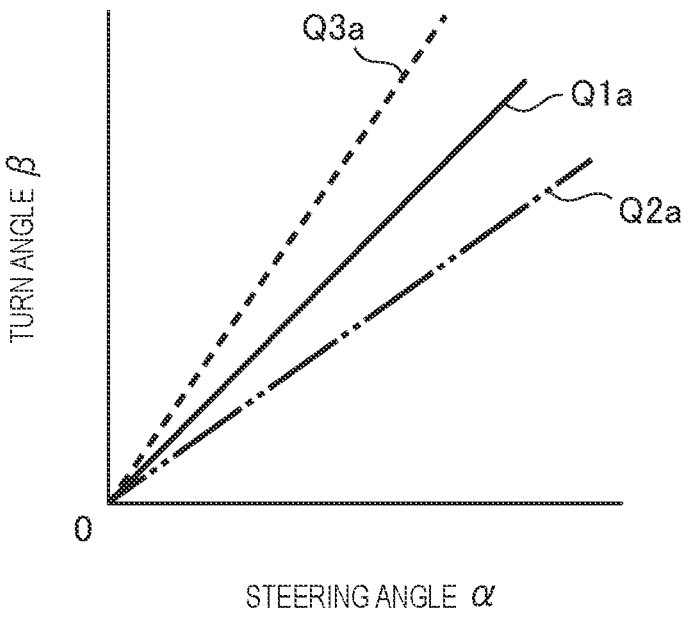
FIG. 6 is a conceptual diagram of a second steering characteristics map stored in a storing unit illustrated in FIG. 4.

The steering characteristics map of the second embodiment (the first steering characteristics map) can be replaced with a steering characteristics map (a second steering characteristics map) illustrated in FIG. 6. According to the second steering characteristics map, all characteristic straight lines Q1a, Q2a, and Q3a have a linear characteristic.

According to the second steering characteristics map, with reference to a basic characteristic straight line Q1a indicated by a continuous line, when the ship speed Vr is fast, a fast-speed characteristic straight line Q2a indicated by a two-dot line is set and when the ship speed Vr is slow, a slow-speed characteristic straight line Q3a indicated by a dashed line is set. The characteristics of the fast-speed characteristic straight line Q2a have a small ratio of the turn angle β relative to the steering angle α with respect to the characteristics of the basic characteristic straight line Q1a. The characteristics of the slow-speed characteristic straight line Q3a have a large ratio of the turn angle β relative to the steering angle α with respect to the characteristics of the basic characteristic straight line Q1a. Note that the characteristic straight lines in accordance with the ship speed Vr are not limited to such three lines, Q1a, Q2a, and Q3a, and may be set more finely.

Thus, both the steering characteristics map illustrated in FIG. 5 and the steering characteristics map illustrated in FIG. 6 have a characteristic such that the slower the speed Vr of the ship 10 (the ship speed Vr) is, the larger the ratio of the turn angle β relative to the steering angle α becomes. Consequently, when the ship travels at a slow speed, since the ship 10 can be turned largely with a little steering amount, the ship handling effort on the ship handling person can be reduced.

Conversely, the characteristic is adopted which decreases the ratio of the turn angle β relative to the steering angle α when the ship travels at fast speed. Hence, the steering operation for correction, such as a wave-following handling and a reverse correction handling, can be reduced, and the response can be improved. Reduction of the steering amount reduces the ship handing load on the ship handling person. The other actions and effects are the same as those of the above-described first embodiment.

Third Embodiment

A ship steering device 230 according to a third embodiment will be described with reference to FIG. 7 to FIG. 9. The ship steering device 230 of the third embodiment has a feature such that a steering angle direction determining unit 251 (a steering angle direction calculating unit 251) is added to the structure of the second embodiment. The detailed description on the same structure as that the second embodiment will be omitted.

Figure 7:
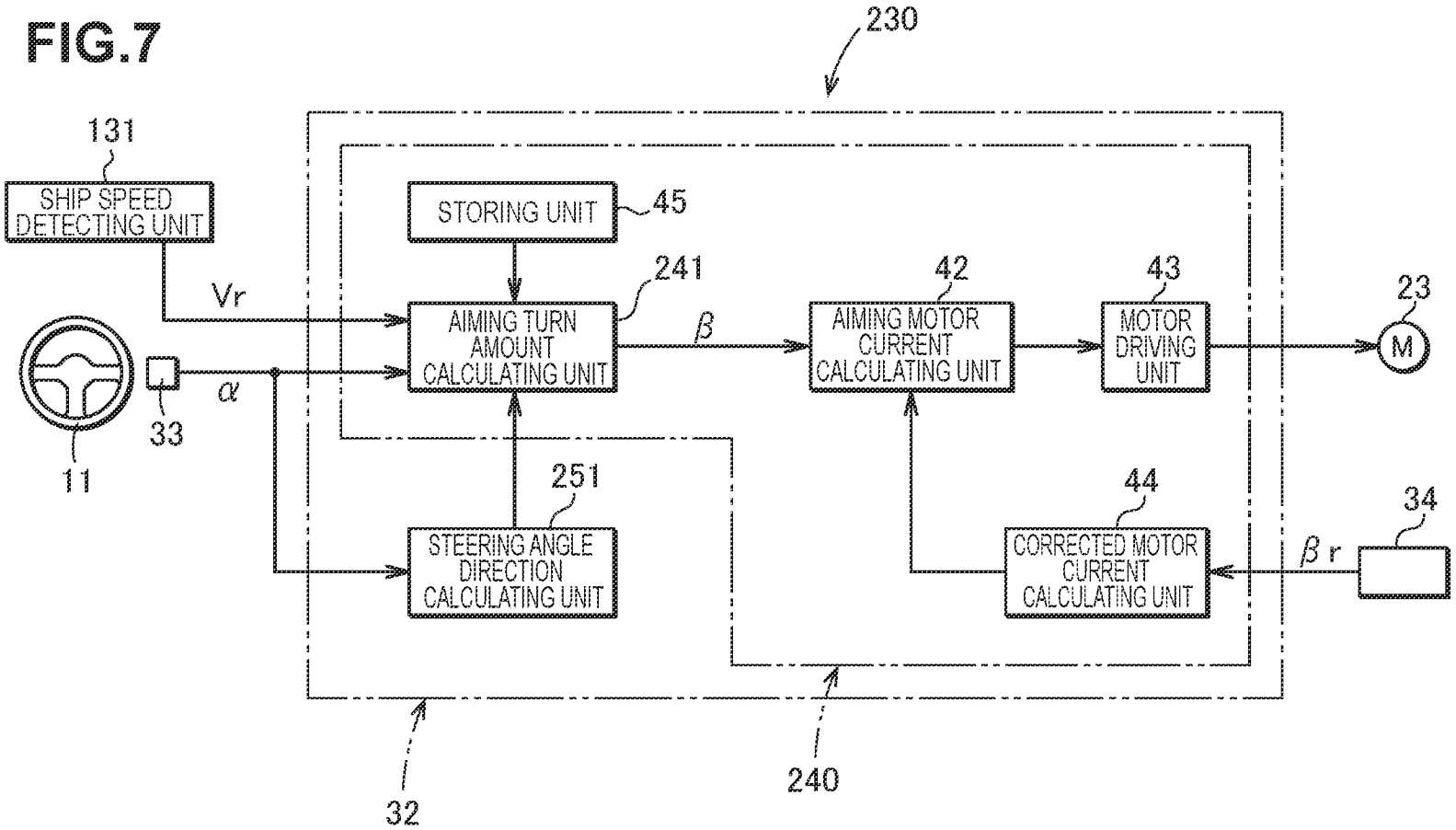
FIG. 7 is a block diagram for describing the details of a control on a ship steering device according to a third embodiment.

As illustrated in FIG. 7, the ship steering device 230 of the third embodiment includes, in the controller 32, the steering angle direction determining unit 251. The steering angle direction determining unit 251 (also referred to as the steering angle direction calculating unit 251) determines the steering direction of the handle 11 based on the steering angle α detected by the steering angle detecting unit 33. A turn controller 240 corresponds to the turn controller 140 of the second embodiment (see FIG. 4).

An aiming turn amount calculating unit 241 of the turn controller 240 calculates the aiming turn angle β in accordance with the steering angle α of the handle 11 detected by the steering angle detecting unit 33, the steering direction of the handle 11 detected by the steering angle direction determining unit 251, and/or the ship speed Vr detected by the ship speed detecting unit 131.

Figure 8:
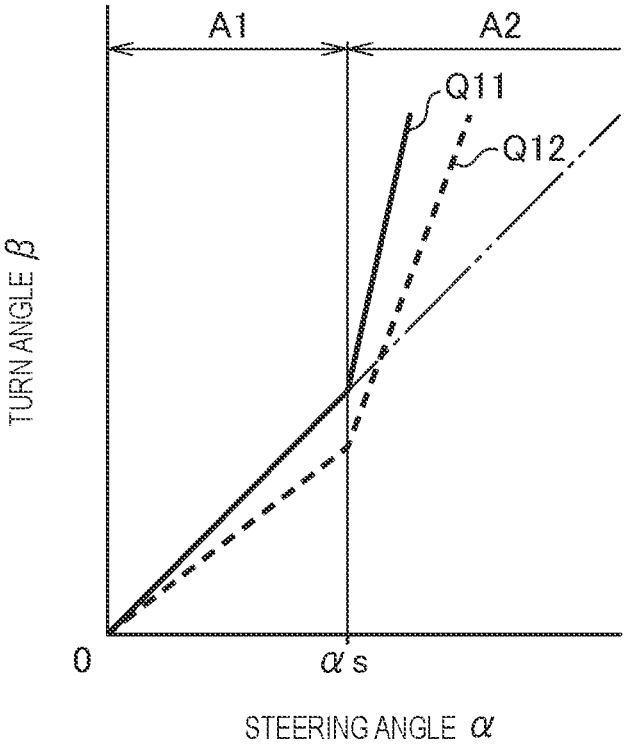
FIG. 8 is a conceptual diagram of a first steering-direction-by-steering-direction steering characteristics map stored in a storing unit illustrated in FIG. 7.

A steering characteristics map of the third embodiment illustrated in FIG. 8 corresponds to that of the first embodiment illustrated in FIG. 3, and has a feature such that there is a difference in the case of the left steering direction of the handle 11 and in the case of the right steering direction thereof. More specifically, the steering characteristics map (a steering-direction-by-steering-direction first steering characteristics map) of the third embodiment illustrated in FIG. 8 has a characteristic defined by the steering angle α and the steering direction of the handle 11.

The characteristics in the case of the "left" steering direction of the handle 11 is represented by a left steering characteristic Q11 with a continuous line. The characteristics in the case of the "right" steering direction of the handle 11 is represented by a right steering characteristic Q12 with a dashed line. The basic characteristic Q1 of the first embodiment (see FIG. 3) is adopted as the left steering characteristic Q11. That is, the left steering characteristic Q11 illustrated in FIG. 8 has the same characteristics as the basic characteristic illustrated in FIG. 3. The right steering characteristic Q12 has a characteristic such that the change amount of the turn angle β relative to the steering angle α is small with respect to the left steering characteristic Q11. Note that the left steering characteristic Q11 and the right steering characteristic Q12 may be opposite characteristics to each other.

Figure 9:
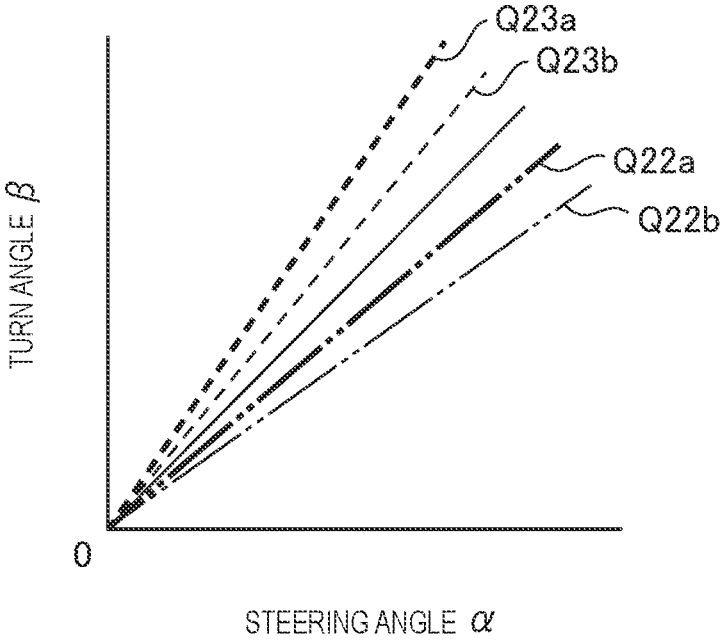
FIG. 9 is a conceptual diagram of a second steering-direction-by-steering-direction steering characteristics map stored in a storing unit illustrated in FIG. 7.
Figure 10:
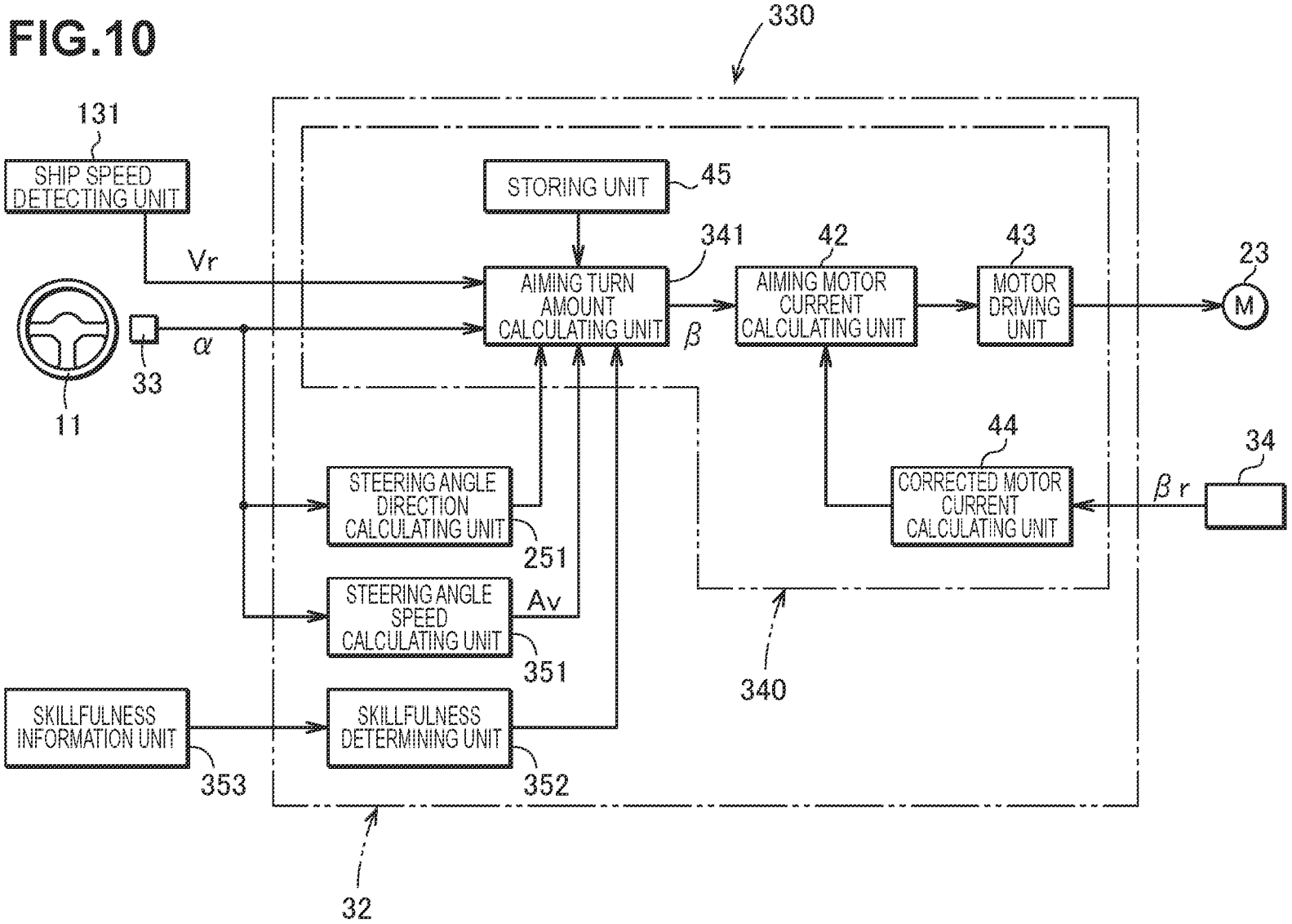
FIG. 10 is a block diagram for describing the details of a control on a ship steering device according to a fourth embodiment.

The steering characteristics map (the steering-direction-by-steering-direction first steering characteristics map) of the third embodiment can be replaced with a steering characteristics map (a steering-direction-by-steering-direction second steering characteristics map) illustrated in FIG. 9. The steering-direction-by-steering-direction second steering characteristics map has a characteristic defined by the steering angle α, the ship speed Vr, and the steering direction of the handle 11. According to the steering-direction-by-steering-direction second steering characteristics map, all characteristic straight lines Q22a, Q22b, Q23a, and Q23b have a linear characteristic.

In the steering-direction-by-steering-direction second steering characteristics map illustrated in FIG. 9, the characteristic straight line Q22a with a thick two-dotted line (a left first characteristic straight line Q22a) has a characteristic when the steering direction of the handle 11 is "left", and the ship speed Vr is "fast speed", and has the same characteristic as that of the fast-speed characteristic straight line Q2a of the second embodiment illustrated in FIG. 6.

The characteristic straight line Q23a (a left second characteristic straight line Q23a) with a thick dashed line has a characteristic when the steering direction of the handle 11 is "left", and the ship speed Vr is "slow speed", and has the same characteristics as that of the slow-speed characteristic straight line Q3a of the second embodiment illustrated in FIG. 6.

The characteristic straight line Q22b (a right first characteristic straight line Q22b) with a thin two-dotted line has a characteristic when the steering direction of the handle 11 is "right", and the ship speed Vr is "fast speed". The right first characteristic straight line Q22b has a characteristic such that the change amount of the turn angle β relative to the steering angle α is small with respect to the left first characteristic straight line Q22a.

The characteristic straight line Q23b (a right second characteristic straight line Q23b) with a thin dashed line has a characteristic when the steering direction of the handle 11 is "right", and the ship speed Vr is "slow speed". The right second characteristic straight line Q23b has a characteristic such that the change amount of the turn angle β relative to the steering angle α is small with respect to the left second characteristic straight line Q23a.

Note that the left first characteristic straight line Q22a and the right first characteristic straight line Q22b may be opposite characteristics to each other. Similarly, the left second characteristic straight line Q23a and the right second characteristic straight line Q23b may be opposite characteristics to each other.

In general, constant displacement force acts on the rudder, i.e., the outboard motor 12 in accordance with the difference in right and left water repelling characteristics of the propeller 14 of the outboard motor 12 illustrated in FIG. 1. Consequently, force (turning force) that causes the ship to always travel so as to be displaced in the certain direction acts on the ship 10. Hence, when the handle 11 is at the neutral position, the ship 10 travels in the certain displacement direction.

In order to address this technical problem, the steering characteristics in the turning direction (the direction in which the ship travels so as to be displaced) in which the response of the ship 10 is sensitive i.e., the ratio of the change in the turn angle β of the outboard motor 12 relative to the steering angle α of the handle 11 is made moderate in order to cancel the difference in right and left water repelling characteristics of the propeller 14. Hence, the controllability can be improved with the response of the ship 10 being taken into consideration. The detailed description on the other actions and effects are the same as those of the second embodiment.

Fourth Embodiment

A ship steering device 330 according to a fourth embodiment will be described with reference to FIG. 10 to FIG. 13. The ship steering device 330 of the fourth embodiment has a feature such that a steering angle speed calculating unit 351 that obtains a steering angle speed Av of the handle 11 from the steering angle α detected by the steering angle detecting unit 33, a skillfulness determining unit 352 that determines the skillfulness level of the ship handling by the ship handling person, and a skillfulness information unit 353 that obtains the information on the skillfulness level of the ship handling by the ship handling person are added to the structure of the third embodiment. The controller 32 includes the steering angle speed calculating unit 351 and the skillfulness determining unit 352. The detailed description on the same structure as that of the third embodiment will be omitted.

The information on the skillfulness level of the ship handling by the ship handling person is transmitted to the skillfulness determining unit 352 from the skillfulness information unit 353. The skillfulness determining unit 352 makes a determination based on the information on the skillfulness level obtained from the skillfulness information unit 353.

The skillfulness information unit 353 is an information source that obtains directly or indirectly the information on the skillfulness level of the ship handling by the ship handling person, and such information may be obtained by one or a combination of any two information sources among the following three information sources.

As for the first information source, the information on the skillfulness can be obtained when the ship handling person gives an operation to change the skillful mode with the own intent (in consideration of the own skillfulness level). When the ship handling person is a beginner, the ship handling person changes the skillful mode with an intent that such a ship handling person wants to handle the ship like the skillful person. The changing operation of the skillful mode may be made through, for example, a switch.

As for the second information source, the information on the skillfulness level can be obtained by monitoring the ship handling characteristics of the ship handling person. In this case, the skillfulness determining unit 352 determines the skillful level by monitoring the divergence of the ship handling characteristics from normative characteristics (by a skillful person).

As for the third information source, the information on the skillfulness level can be obtained using the ID information (including a license record, a ship handling record, etc.,) on the ship handling person utilizing a so-called connected technology. The information on the ship handling person may be obtained from an external information source by a communication device, etc., loaded on the ship 10.

A turn controller 340 corresponds to the turn controller 240 of the third embodiment (see FIG. 7). An aiming turn amount calculating unit 341 of the turn controller 340 corrects, under a condition in which the skillfulness determining unit 352 determines that the skillfulness level has not reached a reference skillfulness level that is set in advance, the turn angle β so as to increase the change in the direction of the ship 10 while the steering angle speed Av is increasing, and corrects the turn angle β so as to reduce the change in the direction of the ship 10 while the steering angle speed Av is decreasing.

Figure 11:
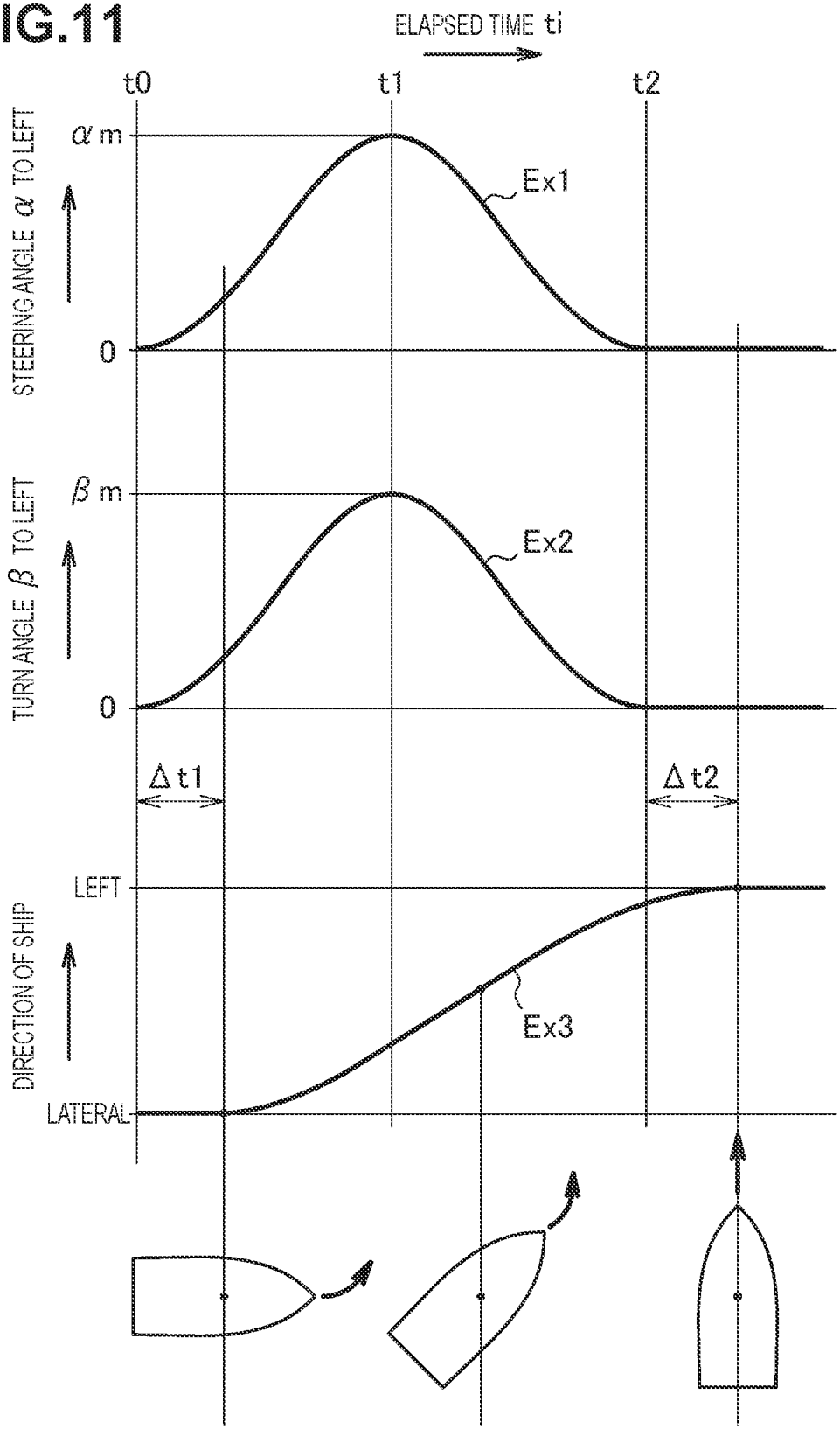
FIG. 11 is an association chart illustrating a relation between the ship handing state of a ship handling person and the behavior of a ship when the ship handling person is determined as a skillful person by a skillfulness determining unit.

FIG. 11 is an association chart illustrating a relation between the ship handing state of a ship handling person and the behavior of the ship 10 when the skillfulness determining unit 352 determines that the skillfulness level of the ship handling person has reached the reference skillfulness level (i.e., the ship handling person is a skillful person) with the horizontal axis representing an elapsed time ti.

A time point at which the elapsed time ti is zero (ti=t0=0) will be defined as a reference time to. At the reference time t0, the ship 10 is traveling linearly from the left side of the figure to the right side thereof (laterally travelling). The skillful person starts, at the reference time t0, the steering increase operation to the handle 11 to the left side so as to cause the ship 10 to turn from the lateral posture to the leftward posture. The relation between the elapsed time and the steering angle when the skillful person turns the handle is indicated by a skillful person steering curve E×1. According to the skillful person steering curve E×1, the steering angle α after the steering increase operation starts and when an elapsed time t1 has elapsed is a maximum steering angle αm. Subsequently, the skillful person carries out the steering return operation, and returns the handle 11 to the neutral position when an elapsed time t2 has elapsed.

The change in the turn angle β of the outboard motor 12 is indicated by a skillful person turn curve E×2. According to the skillful person turn curve E×2, the turn angle β changes basically in a similar manner to the skillful person steering curve E×1. The turn angle β is the maximum turn angle βm when the elapsed time t1 has elapsed. Such an angle returns to the turn angle β=0 (neutral) when the elapsed time t2 has elapsed.

The ship 10 that is travelling laterally starts turning to the left after a delay time Δt1 has elapsed from the reference time t0 at which the steering increase operation of the handle 11 starts. Subsequently, after a delay time Δt2 has elapsed from the elapsed time t2 at which the steering return operation of the handle 11 completes, the ship 10 completes the turn to the left (the ship 10 completes the turn from the lateral posture to the leftward posture). The relation between the elapsed time and the behavior of the ship 10 when the skillful person turns the handle is indicated by a skillful person ship behavior curve E×3.

According to the skillful person steering curve E×1, the skillful person turn curve E×2, and the skillful person ship behavior curve E×3, it becomes apparent that this is a model behavior relationship (normative characteristics) that has a little response delay of the ship 10 relative to the steering operation of the handle 11, i.e., a model behavior relationship of the ship 10 relative to the steering operation of the skillful person.

Figure 12:
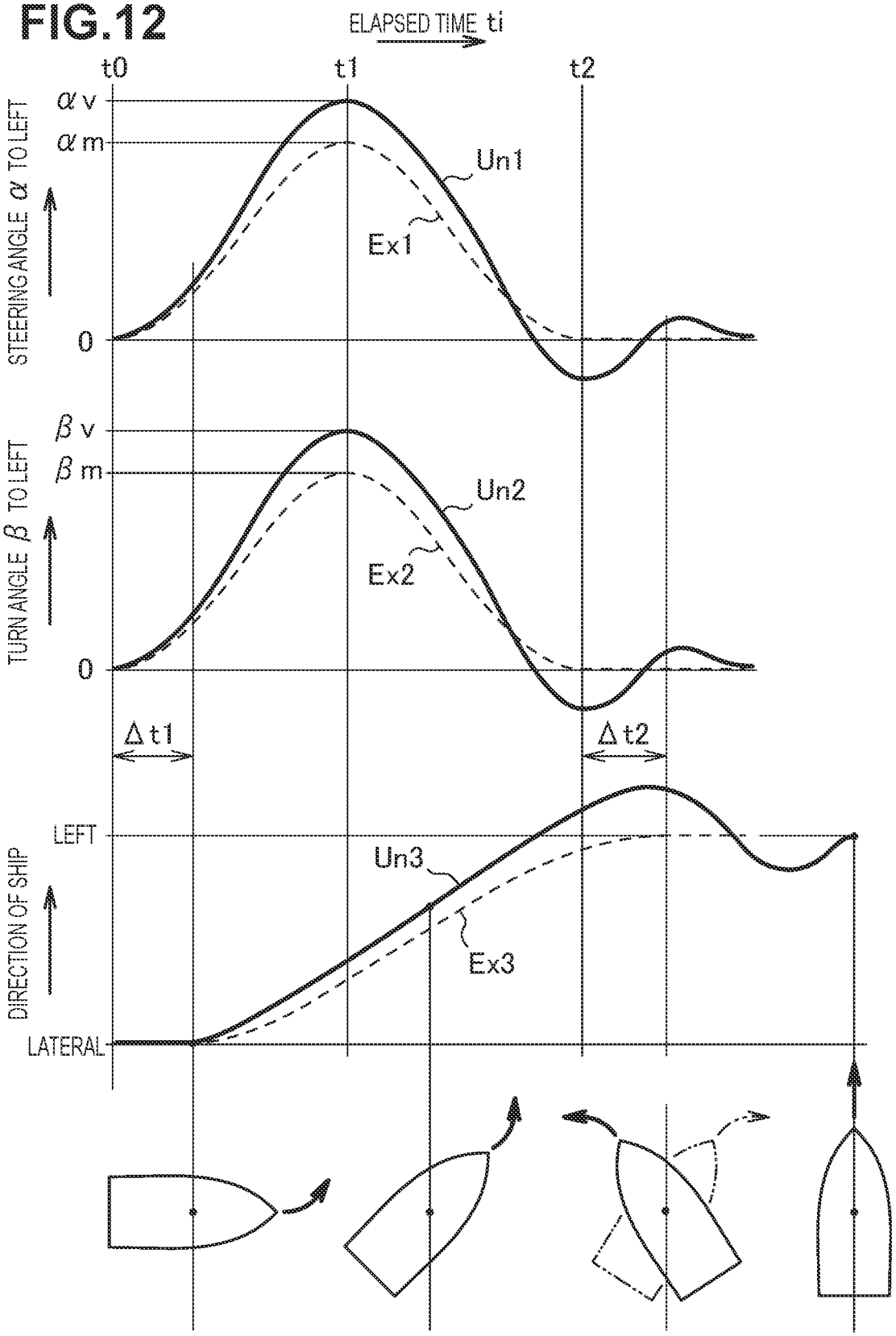
FIG. 12 is an association chart illustrating a relation between the ship handing state of a ship handling person and the behavior of a ship when the ship handing person is determined as a non-skillful person by the skillfulness determining unit.

FIG. 12 corresponds to FIG. 11. FIG. 12 is an association chart illustrating a relation between the ship handling state of a ship handling person and the behavior of the ship 10 when the skillfulness determining unit 352 determines that the skillfulness level of the ship handling person has not reached the reference skillfulness level (i.e., a non-skillful person).

The relation between the elapsed time and the steering angle when a non-skillful person turns the steering is indicated by a non-skillful person steering curve Un1. According to the non-skillful person steering curve Un1, it become apparent that there is a tendency such that a non-skillful person carries out a steering increase operation so as to turn the handle 11 largely, and then carries out a large steering return operation. The steering angle α when the elapsed time t1 has elapsed after the steering increase operation starts is greater than the maximum steering angle αm, and is an excessive steering angle αv. In the case of the steering return operation, also, the handle is returned again (a correction steering operation) after the handle goes over the neutral position, which is an ineffective operation.

The change in the turn angle β of the outboard motor 12 is indicated by a non-skillful person turn curve Un2. According to the non-skillful person turn curve Un2, the turn angle β changes basically in the similar manner to the non-skillful person steering curve Un1. The turn angle β when the elapsed time t1 has elapsed is greater than the maximum turn angle βm, and is an excessive turn angle βv.

The relation between the elapsed time and the behavior of the ship 10 when a non-skillful person turns the handle is indicated by a non-skillful person ship behavior curve Un3. According to the non-skillful person ship behavior curve Un3, the ship 10 that is travelling laterally returns to the right (overshoot to the right) after excessively turning to the left (overshoot to the left), repeats such behaviors, and then completes the turn to the left. Such behaviors have a large response delay of the ship 10 relative to the steering operation of the handle 11.

Figure 13:
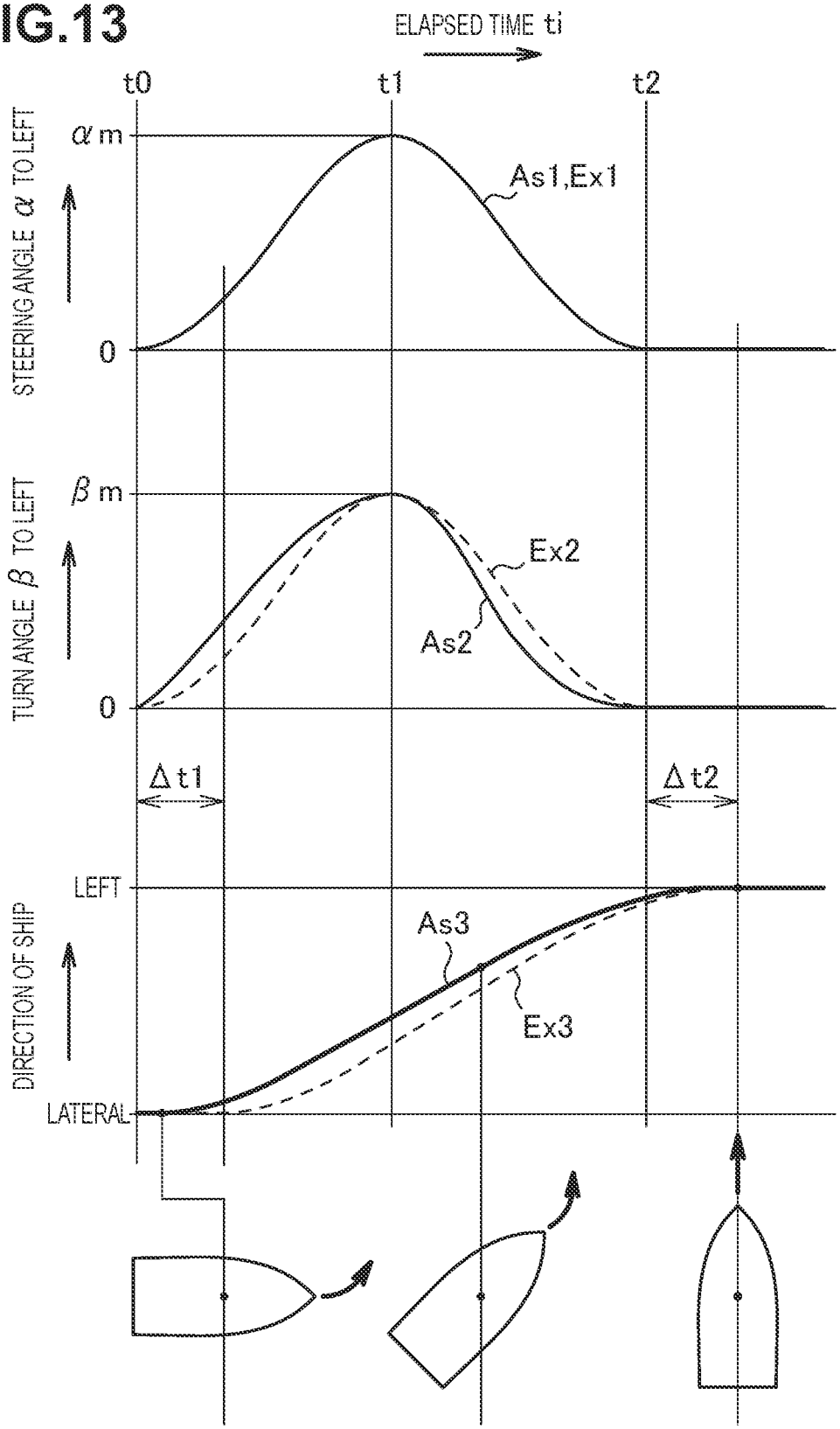
FIG. 13 is an association chart illustrating a relation between the ship handling state of the ship handling person and the behavior of the ship upon executing the control according to the fourth embodiment.

FIG. 13 corresponds to FIG. 11, and is an association chart illustrating a relation between the ship handling state of the ship handling person and the behavior of the ship 10 when the control according to the fourth embodiment is executed. That is, FIG. 13 illustrates a relation between the ship handling state of the ship handling person and the behavior of the ship 10 when the skillfulness determining unit 352 determines that the skillfulness level of the ship handling person has not reached the reference skillfulness level (i.e., a non-skillful person) and under the situation controlled by the turn controller 340.

The relation between the elapsed time and the steering angle when a non-skillful person turns the handle is indicated by a steering curve As1. The steering curve As1 has a normative model that is, for example, the skillful person steering curve E×1 illustrated in FIG. 11. The steering increase operation to turn the handle 11 to the left is carried out until the elapsed time t1 from the reference time to. At this time, in general, the steering angle speed Av is increasing. The steering return operation of the handle 11 is carried out until the elapsed time t2 from the elapsed time t1. At this time, in general, the steering angle speed Av is decreasing.

The change in the turn angle β of the outboard motor 12 is indicated by a turn curve As2. The turn curve As2 has a characteristic such that, for example, a part of the skillful person turn curve E×2 illustrated in FIG. 11 is corrected. The turn angle β when the elapsed time t1 has elapsed is the maximum turn angle βm.

According to the fourth embodiment, while the steering angle speed Av is increasing (from the reference time t0 to the elapsed time t1), the aiming turn amount calculating unit 341 (see FIG. 10) is correcting the turn angle β so as to increase the change in the direction of the ship 10.

Moreover, while the steering angle speed Av is decreasing (from the elapsed time t1 to the elapsed time t2), the aiming turn amount calculating unit 341 (see FIG. 10) is correcting the turn angle β so as to decrease the change in the direction of the ship 10.

The relation between the elapsed time and the behavior of the ship 10 upon correction of the turn angle β by the aiming turn amount calculating unit 341 (see FIG. 10) is indicated by a ship behavior curve An3. As is clear from the ship behavior curve An3, the ship 10 that is travelling laterally takes a turn at a faster time point than the characteristics of the skillful person ship behavior curve E×3.

The fourth embodiment can be summarized as follows.

As illustrated in FIG. 10 to FIG. 13, the ship steering device 330 includes the steering angle speed calculating unit 351 that obtains the steering angle speed Av of the handle 11 from the steering angle α detected by the steering angle detecting unit 33, and the skillfulness determining unit 352 that determines the skillfulness level of the ship handling by the ship handling person. Under the condition in which the skillfulness determining unit 352 determines that the skillfulness level has not reached the preset reference skillfulness level, the turn controller 340 controls the drive current value to drive the rudder motor 23 so as to correct the turn angle β in order to increase the change in the direction of the ship 10 while the steering angle speed Av is increasing, and controls the drive current value to drive the rudder motor 23 so as to correct the turn angle β in order to decrease the change in the direction of the ship 10 while the steering angle speed Av is decreasing.

Thus, when the skillfulness level of the ship handling by the ship handling person has not reached the reference skillfulness level, the rudder motor 23 is controlled so as to correct the turn angle β in accordance with the increase or decrease of the steering angle speed Av of the handle 11. While the steering angle speed Av is increasing, the turn angle β is corrected so as to increase the change in the direction of the ship 10. Conversely, while the steering angle speed Av is decreasing, the turn angle β is corrected so as to decrease the change in the direction of the ship 10. Hence, the turn characteristics (the response, the turn angle, etc.,) of the ship 10 relative to the steering operation of the handle 11 can be corrected so as to become similar to the model behavior (the normative characteristics) of the ship 10 with respect to the skillful person's steering operation. Consequently, an intuitive steering feeling can be achieved which has a little response delay of the ship 10 relative to the steering operation of the handle 11. The other actions and effects are the same as those of the third embodiment.

Fifth Embodiment

A ship steering device 430 according to a fifth embodiment will be described with reference to FIG. 14. The ship steering device 430 of the fifth embodiment has a feature such that a bow behavior detecting unit 451 that detects a physical quantity caused and changed by the rolling of a bow is added to the structure of the second embodiment. The detailed description on the same structure as that of the second embodiment will be omitted. Note that a turn controller 440 of the fifth embodiment corresponds to the turn controller 140 of the second embodiment (see FIG. 4).

As illustrated in FIG. 1, in general, the ship 10 has a phenomenon that is so-called rolling (yawing) of a bow which causes the bow to sway from side to side due to a trim position and to a ship speed. The level of rolling of the bow differs depending on the change in the resistance between the hull of the ship 10 and a water surface, and the change in the water repelling characteristics of the propeller 14 of the outboard motor 12, and has a tendency such that the faster the ship speed is, the larger the bow sways. For example, in a trim-down state (a state in which the difference between the bow draft and stern draft is small) in which the bow is slightly lifted up, since the water surface resistance of the ship 10 is large, the rolling of the bow is relatively small. In a trim-up state in which the bow is lifted up, since the water surface resistance of the ship 10 is small, the rolling of the bow is relatively large. In the trim up state, with the height of the outboard motor 12 being adjusted, since the water surface resistance of the ship 10 is small and the change in the water repelling characteristics of the propeller 14 of the outboard motor 12 is added, the rolling of the bow becomes further large. In order to cope with such a rolling of the bow, a ship handling person often carries out an operation (correcting steering operation) of correcting the traveling direction of the ship 10 in many cases.

Figure 14:
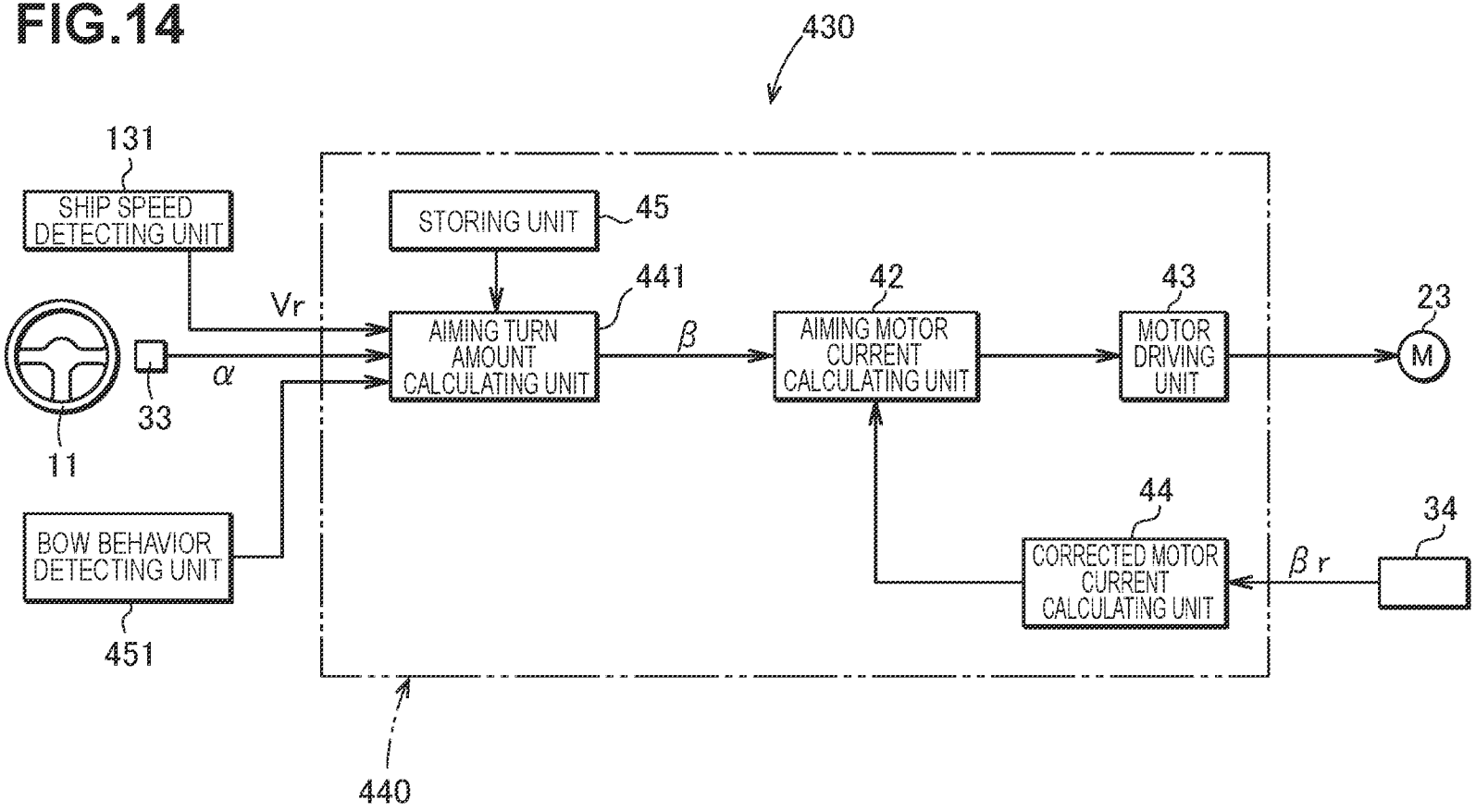
FIG. 14 is a block diagram describing the details of a control by a ship steering device according to a fifth embodiment.

In contrast, the ship steering device 430 of the fifth embodiment illustrated in FIG. 14 includes the bow behavior detecting unit 451. The bow behavior detecting unit 451 detects a physical quantity that occurs and changes in accordance with the rolling of the bow, and examples are a yaw rate detecting unit, a lateral acceleration detecting unit, and a ship inclination amount detecting unit. A yaw rate detecting unit detects a speed (a yaw rate) at which a rotational motion (yawing) around the vertical axis of the ship 10 changes when the ship 10 is travelling. A lateral acceleration detecting unit detects an acceleration in the lateral direction applied to the ship 10 when the ship 10 turns. A ship inclination amount detecting unit detects the posture (an inclination angle) of the ship 10.

The aiming turn amount calculating unit 441 of the turn controller 440 corrects, under a condition in which there is no change in the steering angle α detected by the steering angle detecting unit 33, the aiming turn amount (the aiming turn angle β) so as to suppress the rolling of the bow when the physical quantity detected by the bow behavior detecting unit 451 exceeds a threshold that is set in advance, and outputs the corrected amount to the aiming motor current calculating unit 42. The aiming motor current calculating unit 42 decides the aiming current to the rudder motor 23 in accordance with the corrected aiming turn amount output by the aiming turn amount calculating unit 441. The motor driving unit 43 drives the rudder motor 23 in accordance with the corrected aiming current output by the aiming motor current calculating unit 42.

The fifth embodiment can be summarized as follows.

The ship steering device 430 of the fifth embodiment includes the bow behavior detecting unit 451 that detects a physical quantity which occurs and changes in accordance with the rolling of the bow. The turn controller 440 controls the drive current value that drives the rudder motor 23 so as to suppress the rolling of the bow when there is no change in the steering angle α detected by the steering angle detecting unit 33, and when the physical quantity detected by the bow behavior detecting unit 451 exceeds a threshold that is set in advance.

When the physical quantity detected by the bow behavior detecting unit 451 exceeds the threshold although there is no change in the steering angle α, this indicates that an excessive rolling of the bow occurs. The turn controller 440 controls and drives the rudder motor 23 so as to suppress the rolling of the bow. Since the excessive rolling state of the bow can automatically suppressed, the ship handing effort on the ship handing person can be reduced.

Sixth Embodiment

Figure 15:
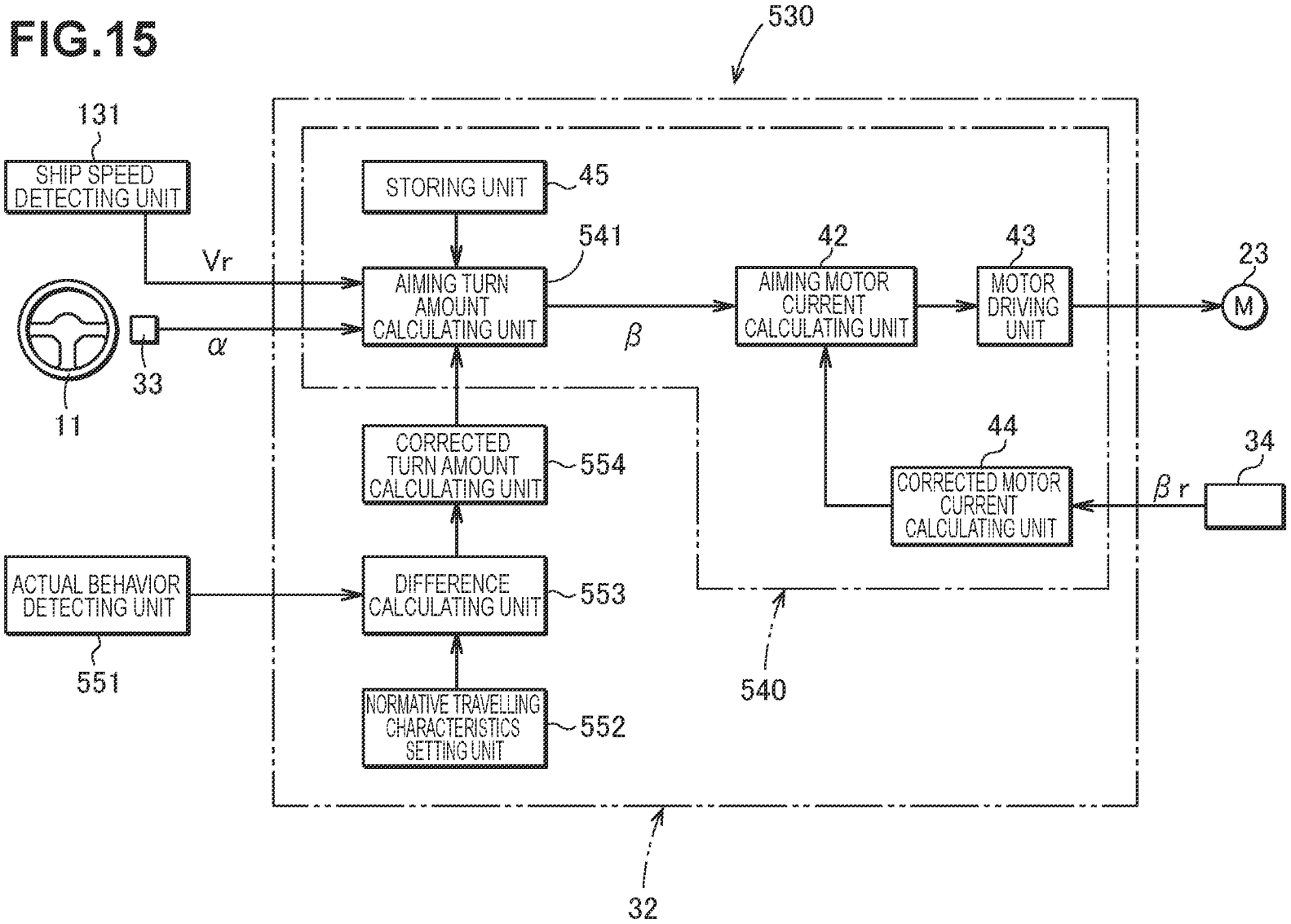
FIG. 15 is a block diagram describing the details of a control by a ship steering device according to a sixth embodiment.

A ship steering device 530 according to a sixth embodiment will be described with reference to FIG. 15 to FIG. 17.

The ship steering device 530 of the sixth embodiment has a feature such that an actual behavior detecting unit 551, a normative travelling characteristics setting unit 552, a difference calculating unit 553, and a corrected turn amount calculating unit 554 are added to the structure of the second embodiment so as to execute an automatic turn correction that causes the ship 10 to travel through a normative travel line (a pass through which the ship travels, and also referred to as a trace line or a normative line). The detailed description on the same structure as that of the second embodiment will be omitted.

The controller 32 includes the normative travelling characteristics setting unit 552, the difference calculating unit 553, and the corrected turn amount calculating unit 554. A turn controller 540 of the sixth embodiment corresponds to the turn controller 140 of the second embodiment (see FIG. 4).

The actual behavior detecting unit 551 detects the actual behavior of the ship 10, i.e., the physical quantity which occurs and changes in accordance with the behavior of the ship 10, and examples are a yaw rate detecting unit, a lateral acceleration detecting unit, and a ship inclination amount detecting unit. A yaw rate detecting unit detects a speed (a yaw rate) at which a rotational motion (yawing) around the vertical axial of the ship 10 changes when the ship 10 is travelling. A lateral acceleration detecting unit detects an acceleration in the lateral direction (a lateral acceleration) applied to the ship 10 when the ship 10 turns. A ship inclination amount detecting unit detects the posture (an inclination angle) of the ship 10.

The normative travelling characteristics setting unit 552 sets normative travelling characteristics that cause the ship 10 to travel along a normative travel line.

As an example, the normative travelling characteristics setting unit 552 sets legitimate physical quantity characteristics, such as a normative yaw rate, a normative acceleration in the lateral direction (a normative lateral acceleration), and a normative inclination angle, calculated from the motion equation of the ship 10 using various kinds of actual measurement values, such as the actual turn angle $\beta r$ and ship speed Vr.

As another example, the normative travelling characteristics setting unit 552 sets legitimate physical quantity characteristics, such as a normative yaw rate, a normative acceleration in the lateral direction (a normative lateral acceleration), and a normative inclination angle, with the actual measurement values of the physical quantity characteristics under a stable environment in which there is no adverse effect of wind or wave being as the normative travelling characteristics.

The difference calculating unit 553 calculates a difference of an actual detection value detected by the actual behavior detecting unit 551 relative to the normative travelling characteristics obtained from the normative travelling characteristics setting unit 552. The difference calculating unit 553 can obtain, for example, the difference of an actual yaw rate relative to the normative yaw rate, the difference of an actual lateral acceleration relative to the normative lateral acceleration, and the difference of an actual inclination angle relative to the normative inclination angle.

The corrected turn amount calculating unit 554 corrects (compensates) the value of the aiming turn amount (the aiming turn angle $\beta$) obtained by the aiming turn amount calculating unit 541 in accordance with the difference obtained by the difference calculating unit 553.

How to control the turn by the ship steering device 530 will be described with reference to FIG. 16 and FIG. 17.

Figure 16:
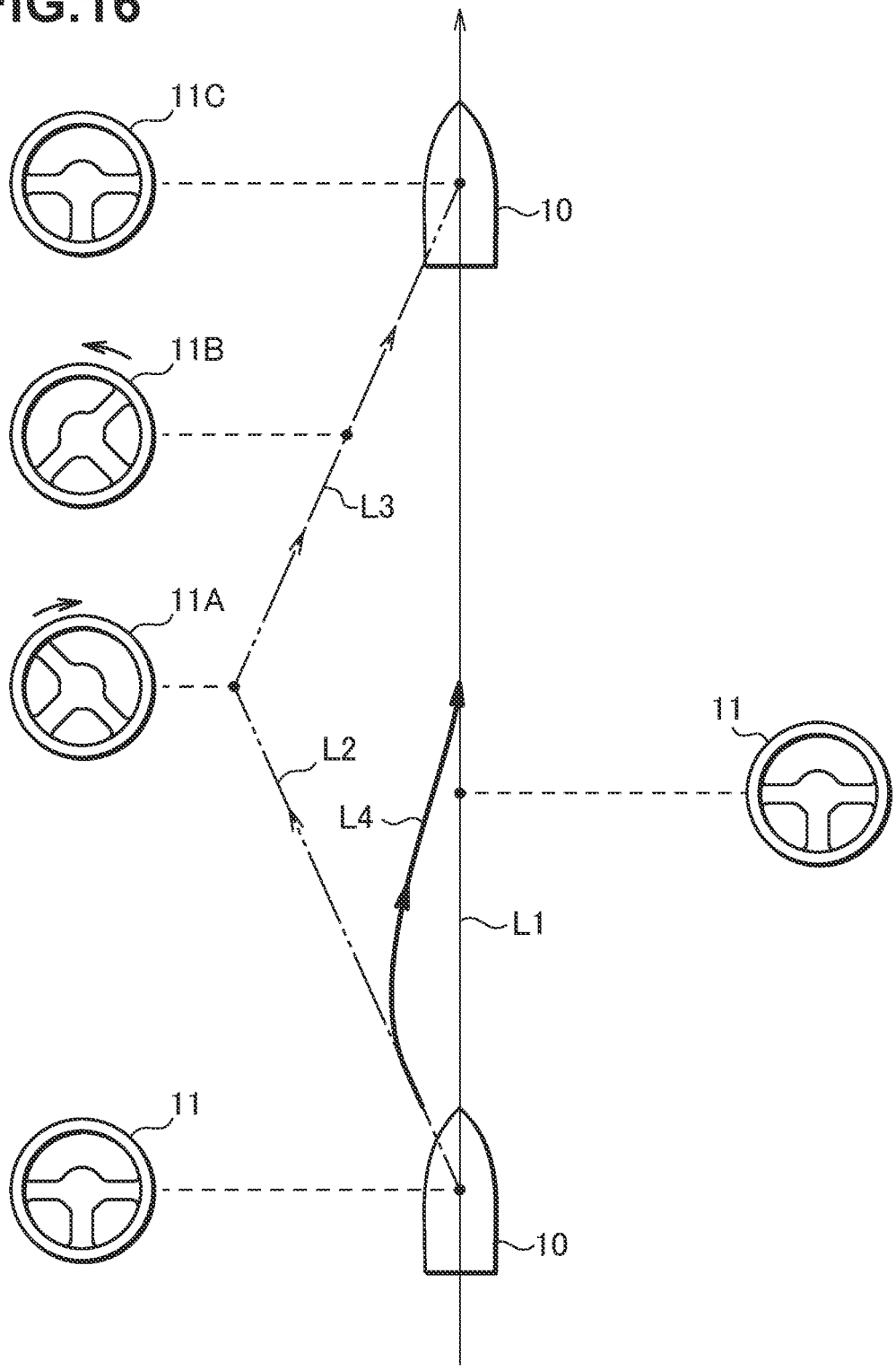
FIG. 16 is an association chart illustrating a relation between the behavior of the ship attempting to travel straight and a handle operation.

FIG. 16 illustrates the behavior of the ship 10 that attempts to travel straightly. First, a description will be given of a case in which the turn control by the ship steering device 530 is not executed. Provided that the ship 10 travels a travel line L1 (a trace line L1 for straight travelling, also referred to as a normative straight traveling line L1) of a normative straight travelling, the handle 11 is at the neutral position. Conversely, the actual ship 10 is travelling a travelling path L2 displaced to the left from the normative straight travel line L1. A ship handling person finds that the ship is out of the normative straight travel line L1, and carries out the right steering increase operation like a handle 11A. Consequently, the ship 10 travels a travelling path L3. The ship handling person carries out a left steering return operation in the halfway of the ship handling like a handle 11B. The ship handling person who confirms that the ship 10 has returned to the normative straight travel line L1 returns the handle to the neutral position like a handle 11C. These are a large ship handling effort on the ship handling person.

In contrast, when the turn control by the ship steering device 530 is executed, the following actions are taken. Although the actual ship 10 travels the travelling path L2 that is displaced to the left from the normative straight travel line L1, the ship steering device 530 executes the correction control. Consequently, the ship 10 travels a corrected path L4, and automatically returns to the normative straight travel line L1. This can reduce the ship handling effort on the ship handling person.

Figure 17:
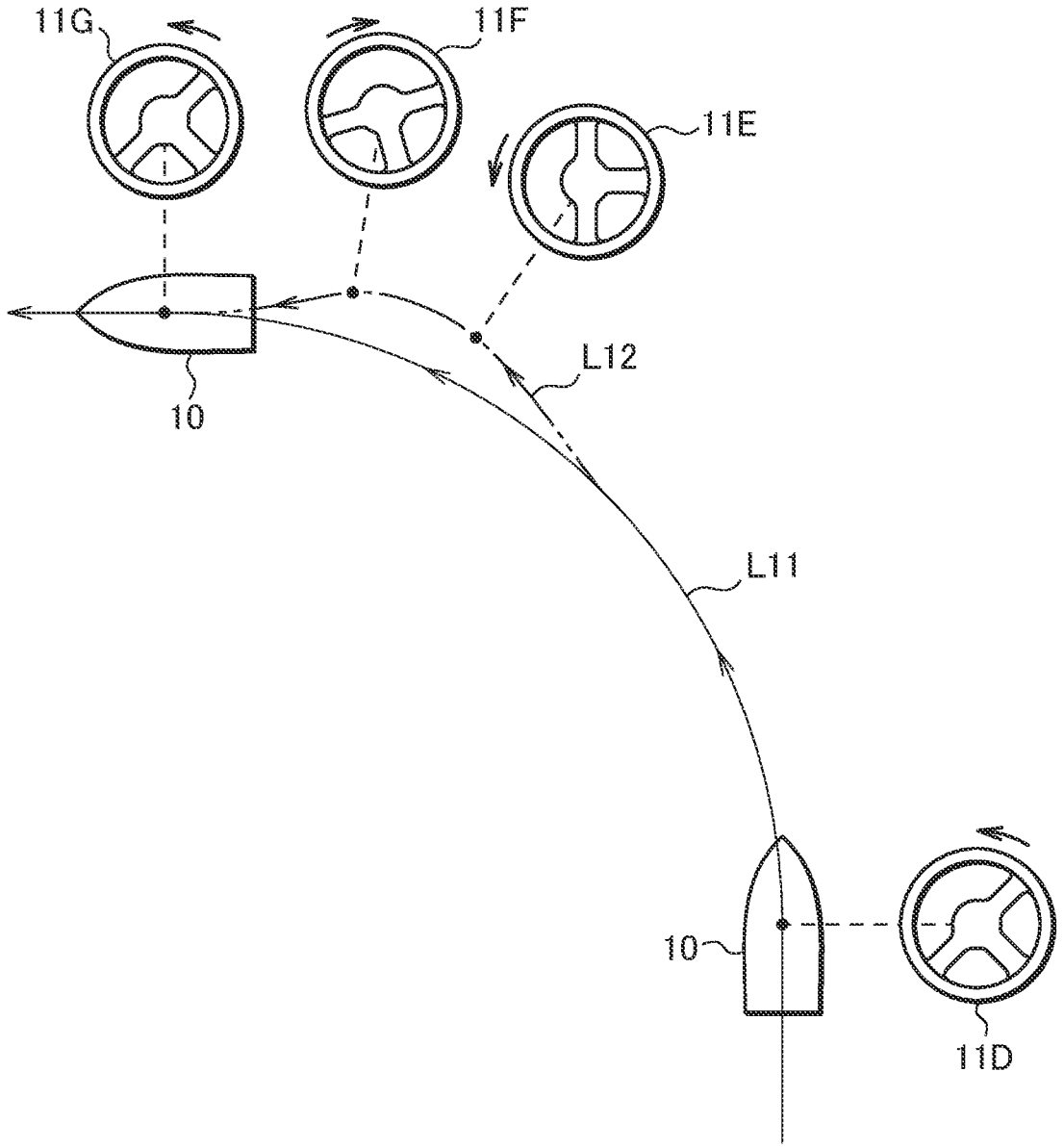
FIG. 17 is an association chart illustrating a relation between the behavior of the ship attempting to turn to the left and a handle operation.

FIG. 17 illustrates the behavior of the ship 10 that attempts to turn to the left. First, a description will be given of a case in which the turn control by the ship steering device 530 is not executed. Provided that a ship handling person carries out a left steering increase operation like a handle 11D, the ship 10 is travelling a detour path L12 that is largely displaced to the right from a normative left turn line L11 although the ship should travel the travel line L11 of the normative left turn (a left turn trace line L11, also referred to as the normative left turn line L11). A ship handling person finds that the ship is out of the normative left turn line L11, and carries out a further left steering increase operation like a handle 11E. The ship handling person finds the excessive steering increase operation, and carries out the right steering return operation like a handle 11F. Consequently, the ship 10 returns to the normative left turn line L11. The ship handling person turns the handle like a handle 11G so as to cause the ship 10 to travel along the normative left turn line L11. These are a large ship handling effort on the ship handling person.

In contrast, when the turn control by the ship steering device 530 is executed, the following actions are taken. When the actual ship 10 attempts to travel the detour path L12 out of the normative left turn line L11, the ship steering device 530 executes the correction control. Consequently, the ship 10 automatically travels the normative left turn line L11. This can reduce the ship handling effort on the ship handling person.

The sixth embodiment can be summarized as follows.

The ship steering device 530 of the sixth embodiment includes the normative travelling characteristics setting unit 552 that sets the normative travelling characteristics for causing the ship 10 to travel the travel lines L1 and L11 which are normative, the actual behavior detecting unit 551 that detects the actual behavior of the ship 10, and the difference calculating unit 553 that calculates the difference of the detection value detected by the actual behavior detecting unit 551 relative to the normative travelling characteristics obtained from the normative travelling characteristics setting unit 552. The turn controller 540 controls the drive current value that drives the rudder motor 23 to correct the turn angle β in such a way that the actual behavior becomes similar to the normative travelling characteristics when the difference obtained by the difference calculating unit 553 exceeds the predetermined difference threshold.

Hence, the displacement amount of the actual travel path relative to the travel lines L1 and L11 that are normative, and the turn angle β of the outboard motor 12 can be automatically corrected. Therefore, the ship handling effort on the ship handling person can be reduced, while at the same time, the comfortableness can be accomplished.

According to the sixth embodiment, the normative travelling characteristics setting unit 552 sets a navigation path to a destination, the actual behavior detecting unit 551 detects an actual GPS trajectory, and the difference calculating unit 553 compares and calculates the difference between the navigation path and the GPS trajectory. This enables a determination on the displacement.

Note that the present disclosure is not limited to the embodiments as long as the actions and effects of the present disclosure can be accomplished.

For example, the ship steering devices 30, 130, 230, 330, 430, and 530 cover a case in which the plurality of outboard motors 12 are loaded on the ship 10.

The ship steering devices 30, 130, 230, 330, 430, and 530 of the respective embodiments can combine the arbitrary embodiments with each other.

According to the fourth to sixth embodiments, the relation between the steering angle α of the handle 11 and the turn angle β of the outboard motor 12 is not limited to the bent characteristics illustrated in FIG. 3, FIG. 5, and FIG. 8, and may be a linear characteristic.

INDUSTRIAL APPLICABILITY

The ship steering devices 30, 130, 230, 330, 430, and 530 of the present disclosure are suitable for the outboard motor 12 loaded on the small ship 10.

What is claimed is:

1. A ship steering device comprising:

an outboard motor attachable to a ship;

a rudder motor that drives a rudder mechanism of the outboard motor;

a handle which is mechanically separated from the rudder mechanism, and which is capable of electrically operating the rudder mechanism;

a steering angle detecting unit that detects a steering angle of the handle;

a reaction force motor that generates reaction force torque to be applied to the handle;

a storing unit that stores a steering characteristics map which associates a basic relation between the steering angle and a turn angle of the outboard motor; and a turn controller that controls, based on the steering characteristics map, a drive current value which drives the rudder motor so as to obtain the turn angle in accordance with the steering angle, wherein the steering characteristics map has a first steering region in which the steering angle is a first steering angle that is between zero and an upper boundary steering angle and a second steering region in which the steering angle is a second steering angle that is greater than the first steering angle in the first steering region, and wherein a change amount of the turn angle relative to the second steering angle is larger than a change amount of the turn angle relative to the first steering angle.

2. The ship steering device according to claim 1, further comprising a ship speed detecting unit that detects a speed of the ship, wherein the steering characteristics map has a characteristic such that the faster the speed is, the smaller the ratio of the turn angle relative to the steering angle becomes.

3. The ship steering device according to claim 1, further comprising a steering angle direction determining unit that determines a steering direction of the handle based on the steering angle, wherein the steering characteristics map has a right steering characteristic when the steering is turned in a right direction, and a left steering characteristic when the steering is turned in a left direction, and wherein the turn controller selects the right steering characteristic or the left steering characteristic in accordance with the steering direction determined by the steering angle direction determining unit, and controls the drive current value that drives the rudder motor based on the selected characteristic.

4. The ship steering device according to claim 1, further comprising:

a steering angle speed calculating unit that obtains a steering angle speed of the handle from the steering angle detected by the steering angle detecting unit;

a skillfulness information unit that directly or indirectly obtains information on a skillfulness level of ship handling by a ship handling person, and a skillfulness determining unit that determines the skillfulness level of ship handling by the ship handling person based on the skillfulness level obtained by the skillfulness information unit, the skillfulness information unit obtains the information on the skillfulness level by one or a combination of any two information sources among following three sources:

a first information source wherein information on the skillfulness level can be obtained when the ship handling person gives an operation to change a skillful mode, a second information source wherein information on the skillfulness level can be obtained by monitoring a ship handling characteristics of the ship handling person, and a third information source wherein information on the skillfulness level can be obtained using an ID information of the ship handling person, wherein, under a condition in which the skillfulness determining unit determines that the skillfulness level has not reached a preset reference skillfulness level, the turn controller:

controls the drive current value to drive the rudder motor so as to correct the turn angle in order to increase a change in a direction of the ship while the steering angle speed is increasing; and controls the drive current value to drive the rudder motor so as to correct the turn angle in order to decrease the change in the direction of the ship while the steering angle speed is decreasing.

5. The ship steering device according to claim 1, further comprising a bow behavior detecting unit that detects a physical quantity which occurs and changes in accordance with a rolling of a bow, wherein the turn controller controls the drive current value that drives the rudder motor so as to suppress the rolling of the bow when there is no change in the steering angle detected by the steering angle detecting unit, and when the physical quantity detected by the bow behavior detecting unit exceeds a threshold that is set in advance.

6. The ship steering device according to claim 1, further comprising:

a normative travelling characteristics setting unit that sets a normative travelling characteristic for causing the ship to travel a travel line which is normative;

an actual behavior detecting unit that detects an actual behavior of the ship; and a difference calculating unit that calculates a difference of a detection value detected by the actual behavior detecting unit relative to the normative travelling characteristics obtained from the normative travelling characteristics setting unit, wherein the turn controller controls the drive current value that drives the rudder motor to correct the turn angle in such a way that the actual behavior becomes similar to the normative travelling characteristics when the difference obtained by the difference calculating unit exceeds a predetermined difference threshold.

* * * * *